US008757682B2

(12) United States Patent
Scholz et al.

(10) Patent No.: US 8,757,682 B2
(45) Date of Patent: Jun. 24, 2014

(54) MOTOR VEHICLE DOOR LOCK

(75) Inventors: Michael Scholz, Essen (DE); Holger Schiffer, Meerbusch (DE); Uwe Reddmann, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 484 days.

(21) Appl. No.: 13/119,564

(22) PCT Filed: Sep. 18, 2009

(86) PCT No.: PCT/DE2009/001321

§ 371 (c)(1),
(2), (4) Date: Apr. 20, 2011

(87) PCT Pub. No.: WO2010/034296

PCT Pub. Date: Apr. 1, 2010

(65) Prior Publication Data

US 2011/0187132 A1 Aug. 4, 2011

(30) Foreign Application Priority Data

Sep. 24, 2008 (DE) ..... 10 2008 048 773

(51) Int. Cl.
*E05C 3/06* (2006.01)
*E05B 65/12* (2006.01)
*E05C 3/00* (2006.01)

(52) U.S. Cl.
CPC ..... *E05B 81/14* (2013.01); *E05B 81/20* (2013.01)
USPC ..... 292/201; 292/216

(58) Field of Classification Search
CPC ..... E05B 81/14; E05B 81/20
USPC ..... 292/201, 216
See application file for complete search history.

(56) References Cited

U.S. PATENT DOCUMENTS

| | | | | | |
|---|---|---|---|---|---|
| 4,518,180 | A * | 5/1985 | Kleefeldt et al. | ..... | 292/201 |
| 5,639,130 | A * | 6/1997 | Rogers et al. | ..... | 292/216 |
| 5,938,252 | A * | 8/1999 | Uemura et al. | ..... | 292/201 |
| 6,000,257 | A * | 12/1999 | Thomas | ..... | 70/279.1 |
| 6,386,599 | B1 * | 5/2002 | Chevalier | ..... | 292/201 |
| 6,659,515 | B2 * | 12/2003 | Raymond et al. | ..... | 292/201 |
| 7,059,640 | B2 * | 6/2006 | Tensing et al. | ..... | 292/201 |
| 7,384,080 | B2 * | 6/2008 | Kachouh | ..... | 292/201 |
| 2004/0094971 | A1 * | 5/2004 | Warmke et al. | ..... | 292/201 |

FOREIGN PATENT DOCUMENTS

| | | | |
|---|---|---|---|
| DE | 199 33 371 | A1 | 2/2000 |
| DE | 100 19 668 | A1 | 10/2001 |
| EP | 1 319 780 | A | 6/2003 |

* cited by examiner

*Primary Examiner* — Carlos Lugo
(74) *Attorney, Agent, or Firm* — Konomi Takeshita

(57) ABSTRACT

A motor vehicle door lock, comprising a locking mechanism (3, 4) and a closing/opening device (5 to 12), containing at least a drive (5, 6, 7, 8, 9) and a lever actuating mechanism (10, 11, 12), wherein the lever actuating mechanism (10, 11, 12) in its engaged state provides a mechanically effective connection between the drive (5, 6, 7, 8, 9) and the locking mechanism (3, 4) and is moved into its disengaged state through using a triggering lever (14).

6 Claims, 4 Drawing Sheets

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 10 2008 048 773.2, filed on Sep. 24, 2008. The entire disclosure of the aforesaid application is incorporated herein by reference.

FIELD OF THE INVENTION

The present invention relates to a motor vehicle door lock comprising a locking mechanism and a closing/opening device, containing at least one drive and a lever actuating mechanism.

BACKGROUND OF THE INVENTION

The closing/opening device acts on the locking mechanism to either close or open it. This is achieved by means of the drive, which is being regularly acted upon during, for instance closing, when a respective motor vehicle door is in its intermediate closed position. The drive and the closing device then ensure that the motor vehicle door can be moved from its intermediate closed position or intermediate locked position to a fully closed position or fully locked position of the respective door lock.

Because of the additional mechanical requirements and thus associated costs, such closing devices or closing aids are at present predominantly reserved for expensive and exclusive cars. Such vehicles also often feature heavier motor vehicle doors, required, amongst other things for additional installations, such as side airbags, reinforcements, etc. Closing devices do, in any case, significantly increase the level of comfort and also have a considerable significance as a safety component, as they ensure that the respective motor vehicle door is in any case moved into the fully closed position, the only way in which the present high safety standards can be achieved in the event of an accident. This is not the case in the intermediate closed position.

Apart from the above, also so-called opening aids are known that are also operated with the aid of a drive and support the opening of a respective motor vehicle door or tailgate. Such opening aids also take into account the heavier weight of the motor vehicle doors or tailgates and increase the level of comfort.

In a motor vehicle door lock of the type described above, corresponding to EP 1 319 780 A1, the lever actuating mechanism of the closing/opening device is based on a relatively complicated design and uses numerous individual components. The result is a complex and costly design of the closing/opening device consisting of the drive and the lever actuating mechanism. The functionality is also not always satisfactory, as considerable operating forces are required to interrupt the closing movement.

SUMMARY OF THE INVENTION

The invention is based on the technical problem of further developing a motor vehicle door lock of the type described above in such a way that, whilst providing a simple and cost-effective design, the required operating forces are significantly reduced, in particular when interrupting the closing movement.

In order to solve this technical problem, a motor vehicle door lock of the above type is provided in which the lever actuating mechanism in its engaged state produces a mechanically effective connection between the drive and the locking mechanism and is moved into its disengaged state with the aid of a triggering lever and where necessary by releasing the locking mechanism.

Normally, the triggering lever for the lever actuating mechanism is acted upon by a lock actuating lever, serving to open the locking mechanism. This means that the triggering lever or ejecting lever for the lever actuating mechanism of the closing/opening device interacts with said lock actuating lever to open the locking mechanism. This lock actuating lever can be an internal operating lever, an external operating lever or also a so-called main actuating lever. The internal operating lever and the external operating lever both act on such a main actuating lever.

The embodiment of the invention ensures in any case that the force of the lock actuating lever (internal operating lever, external operating lever, main actuating lever) acts directly on the triggering lever or ejecting lever. As a result of the triggering lever or ejecting lever being acted upon, the mechanically effective connection between the drive and the locking mechanism is interrupted instantly.

To achieve this, the triggering lever or ejecting lever acts on the lever actuating mechanism in such a way that it is moved from its engaged state into its disengaged state. Simultaneously with moving into the disengaged state, the locking mechanism is released, where applicable. In this way a closing movement of the closing/opening device of the invention can, for instance, be interrupted at any time without problem and with little force and can, in the example, open the respective motor vehicle door. To achieve this, an operator would only have to apply a force with the aid of the lock actuating lever onto the triggering lever or ejecting lever, which in turn moves the lever actuating mechanism from its engaged state into its disengaged state. This requires only a minimum force and provides a responsive action. So if, for instance, a child jams its hand in the motor vehicle door when closing the door, the child's operating force will suffice to directly disengage the lever actuating mechanism and to release the locking mechanism or, in any case, to stop the closing process.

As a result, the closing operation is immediately interrupted and the respective motor vehicle door can, due to the released locking mechanism, be easily opened from either the inside or the outside—if the unit is first disengaged. With the aid of the lock actuating lever the lever actuating mechanism can be interrupted to open the locking mechanism from the inside and from the outside. This is possible, as the lock actuating lever is an internal operating lever and/or the external operating lever or a main actuating lever, acted upon by the internal operating lever and the external operating lever. The internal operating lever is usually mechanically connected to an internal door handle, whilst the external door handle acts on the external operating lever.

These are the main advantages of the invention.

It has proven to be advantageous for the lever actuating mechanism acted upon by the drive and engaging in the locking mechanism to consist of at least two parts. In most cases a driving pawl and a latching pawl are used. The driving pawl is directly or indirectly being acted upon by the drive, whilst the latching pawl ensures that the driving pawl does or does not interact with the locking mechanism.

Normally, both pawls, i.e. the driving pawl and the latching pawl are jointly arranged and preferably axially offset on an operating element or actuating lever. This operating element is acted upon by the drive. For this purpose, the drive normally contains a cam, acting upon the operating element or the actuating lever. This cam solution allows the drive to be returned, for instance, after the closing operation into its initial position, without being followed by the actuating lever.

The design of the triggering lever or ejecting lever is such that it regularly acts on the latching pawl. This ensures that the latching pawl blocks the driving pawl in the engaged position of the lever actuating mechanism and releases it in the disengaged position of the lever actuating mechanism. As the movement of the drive is transferred via the cam onto the operating element on which it acts, the driving pawl can only act on the locking mechanism, when the latching pawl blocks the driving pawl in the engaged state of the lever actuating mechanism. Only in this case does the lever actuating mechanism and thus the driving pawl engage in a pin of the locking mechanism. The pin is in most cases located on a rotary latch of the locking mechanism and serves in most cases to move the mechanism from the intermediate closed position into the fully closed position.

If the latching pawl does, however, not ensure the blocking of the driving pawl in the engaged state of the lever actuating mechanism, the driving pawl can evade the said pin on the locking mechanism and the locking mechanism is released from the lever actuating mechanism and thus the entire closing/opening device.

In addition, a spring acting upon the rotary latch and thus the locking mechanism in order to open these, ensures that when the lever actuating mechanism assumes its disengaged state, the driving pawl is automatically disengaged by the force of the rotary latch or of the spring assigned to it. The driving pawl is thus self-ejecting.

To achieve this, the driving pawl also and advantageously contains a so-called pre-cut. This means that according to a preferred embodiment, the lever actuating mechanism contains a pre-cut in the area of its contact surface with the locking mechanism. In this way, the locking mechanism, which is acted upon by a spring in the "open" direction, is able to directly eject the disengaged lever actuating mechanism. This means that the pre-cut in the driving pawl of the lever actuating mechanism supports the ejecting movement of the driving pawl, as soon as it is no longer held in position by the latching pawl. This is the case immediately after the triggering lever or ejecting lever acts upon the latching pawl. As a result of this quasi-automatic operation and the use of the already present force of the spring of the locking mechanism for the assumption of the disengaged state of the lever actuating mechanism, the operating force on the lock actuating lever is significantly reduced.

It has proven to be advantageous for the actuating lever or the operating element for opening the locking mechanism to be designed as a single-arm lever mounted at one end and being angled, where necessary. As a result, the drive provided on the cam can easily act upon said actuating lever at its free end. In most cases, the respective actuating lever is arranged on the same axis as the rotary latch of the locking mechanism, resulting in a particularly compact and cost-effective arrangement. This arrangement also ensures that the drive with the cam can be located directly above the locking mechanism or the rotary latch and that it can consequently also be used in very narrow motor vehicle door locks.

The activation of the latching pawl and thus the lever actuating mechanism assuming the disengaged state and thus the interruption of the mechanically effective connection between the drive and the locking mechanism only requires a low activation force. In case of an intentional (emergency) interruption of, for instance, the closing movement, a direct and a low operating force response can be expected. These are the main advantages of the invention.

BRIEF DESCRIPTION OF THE DRAWINGS

Below, the invention is explained in more detail with reference to the accompanying, exemplary drawings showing only one embodiment, as follows.

Figure 1:
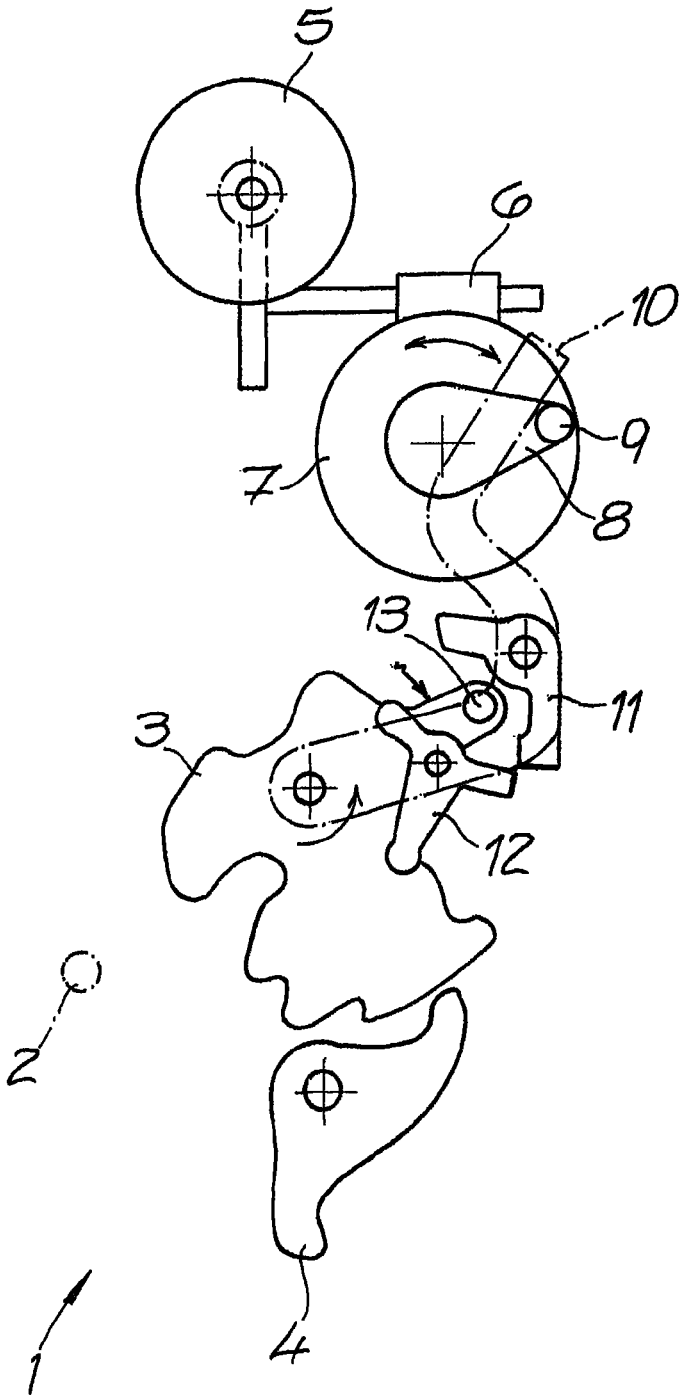
FIG. 1 shows the motor vehicle door lock of the invention in the "open" position of the rotary latch or locking mechanism

Other features and advantages of the present invention will become apparent from the following detailed description, taken in conjunction with the accompanying drawings which illustrate, by way of example, the principles of the invention.

DETAILED DESCRIPTION OF THE INVENTION

The figures show a motor vehicle door lock comprising as usual the mainly shown motor vehicle door lock 1 and a locking bolt 2—only indicated. The locking bolt 2 is normally mounted on a respective vehicle body, whilst the motor vehicle door lock 1 is secured to a not expressly shown motor vehicle door. The motor vehicle door lock or the motor vehicle door closure 1 contains a usual locking mechanism 3, 4 comprising a rotary latch 3 and a pawl 4.

The motor vehicle door lock furthermore contains a closing/opening device 5 to 12, designed in this case as a closing aid 5 to 12. The closing/opening device 5 to 12 contains at least one drive 5, 6, 7, 8, 9 and one lever actuating mechanism 10, 11, 12.

The drive 5, 6, 7, 8, 9 comprises a motor or electric motor 5 and a driving worm 6, arranged on a driving axis on an output side of the motor 5 and which is rotated with the aid of the motor 5. Rotations of the driving worm 6 cause a meshing worm gear 7 to rotate clockwise or anti-clockwise depending on the direction of rotation of the reversing motor or electric motor 5, as indicated by the double arrow in FIG. 1.

Figure 2:
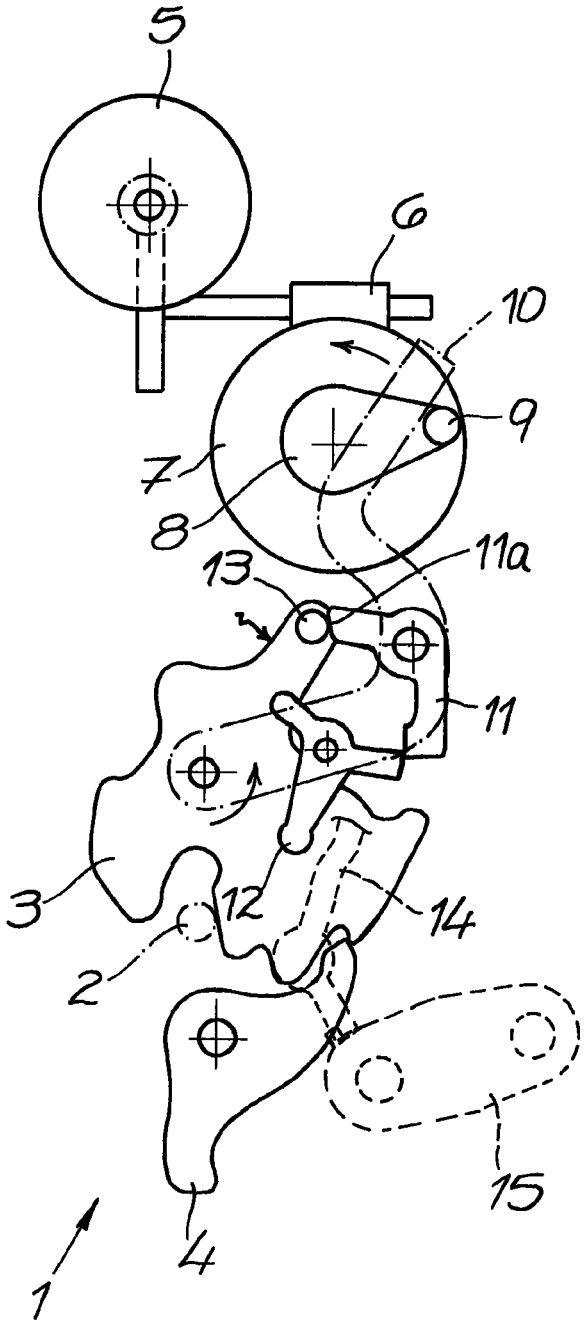
FIG. 2 shows the motor vehicle door lock of FIG. 1 in its intermediate closed position.
Figure 3:
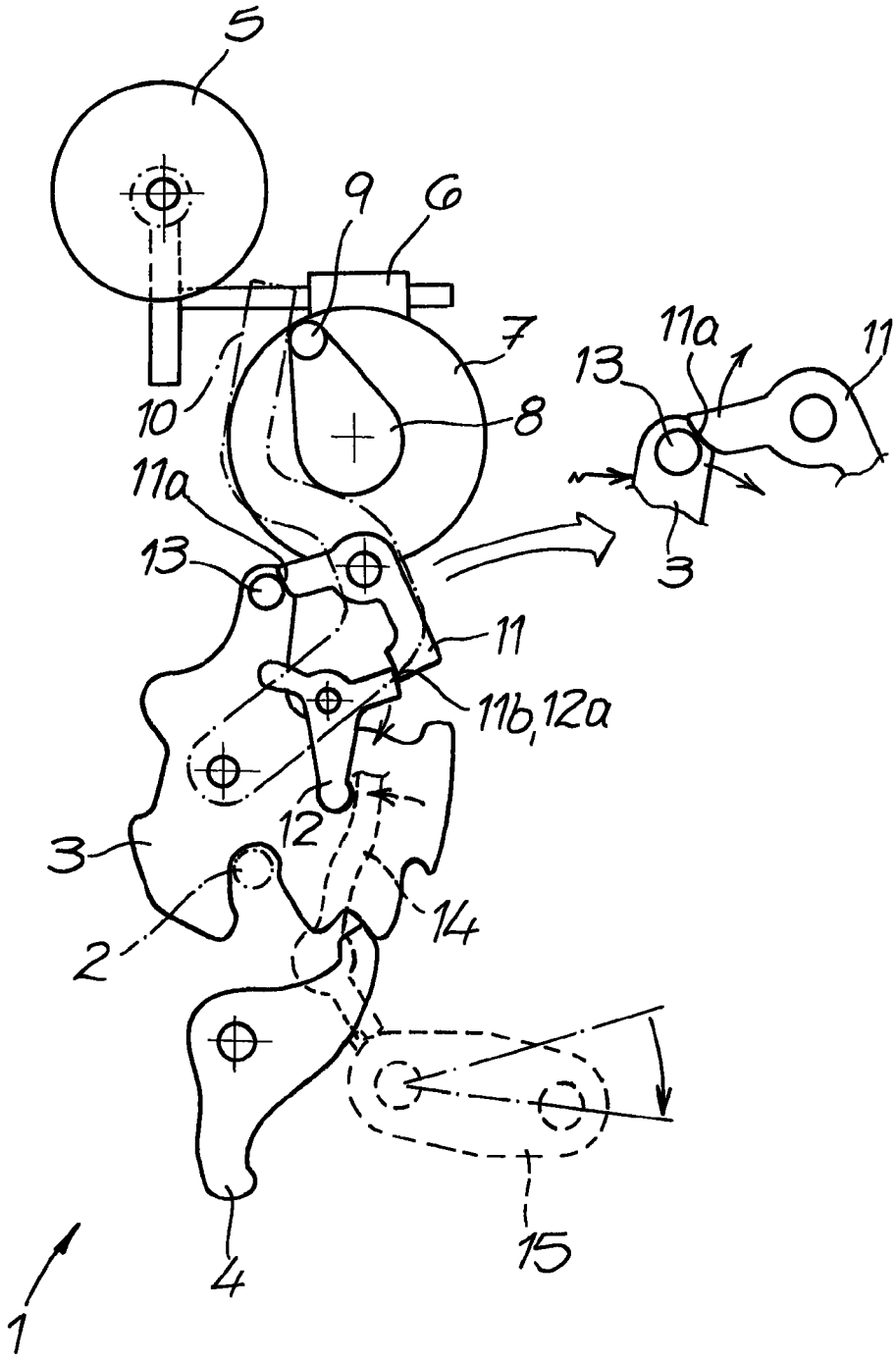
FIG. 3 shows the object of FIGS. 1 and 2 in its fully closed position.

As a result of this rotation, a cam 8 arranged on the worm gear 7 on the same axis as said gear and containing a pin 9 at its end moves in the way apparent from a comparative observation of FIGS. 1 to 3. When changing from the intermediate closed position shown in FIG. 2 to the fully closed position shown in FIG. 3 the drive 5, 6, 7, 8, 9 of the motor vehicle door lock 1 is acted upon in such a way that the pin 9 at the end of the cam 8 carries out an anti-clockwise rotation.

During this process, the pin 9 of the drive 5, 6, 7, 8, 9 strikes against an actuating lever or operating element 10 of the lever actuating mechanism 10, 11, 12. The actuating lever 10 is predominantly designed as a single-arm lever with one of its ends being arranged on the same axis as the rotary latch 3. This means that the rotary latch 3 and the actuating lever 10 have the same axis of rotation. The cam 8 or the pin 9 of drive 5,6,7,8,9 engages with the free end of the angled actuating lever 10.

Apart from the actuating lever 10, the lever actuating mechanism 10, 11, 12 contains two pawls 11, 12 as main components, i.e. a driving pawl 11 and a latching pawl 12. Both the driving pawl 11 and the latching pawl 12 are arranged on the actuating lever 10 and are both axially offset with respect to each other.

Of special significance for the functioning is a pin 13 on the locking mechanism 3, 4 or, more precisely, on the rotary latch 3, interacting with the driving pawl 11, as described below. Finally there is a triggering lever or ejecting lever 14, one end of which interacts with the latching pawl 12 whilst the other is connected to a lock actuating lever 15.

In the example, the lock actuating lever 15 is an external operating lever mechanically connected to the external door handle. Alternatively or in addition, the triggering lever or the ejecting lever 14 can, however, also be connected to an internal operating lever or a main actuating lever of the motor vehicle door lock. As usual, the internal operating lever is operatively connected to an internal door handle. The main actuating lever can be acted upon by the internal door handle and by the external door handle to which it is mechanically connected but which is not shown in the drawing.

The arrangement functions as follows. Starting from the "open" position of the locking mechanism 3, 4 or of the rotary latch 3 in FIG. 1, an operator initially moves the motor vehicle door into the intermediate closed position or the intermediate locked position as shown in FIG. 2. To achieve this, the locking bolt 2 engages in a respective opening in the rotary latch 3 in the usual manner, pivoting it in this example in anti-clockwise direction until reaching the intermediate closed position shown in FIG. 2. This intermediate closed position or intermediate locked position can, for instance, be detected by a sensor and causes an immediate start of the motor 5.

The direction of the motor 5 is set in such a way that when the worm gear 7 on which it acts carries out the already described anti-clockwise quarter turn when moving from FIG. 2 to FIG. 3. During this process, the pin 9 of the cam 8 strikes against the actuating lever 10 of the lever actuating mechanism 10, 11, 12 whilst the driving pawl 11 with its contact surface 11*a* ensures that the rotary latch 3 and the locking mechanism 3, 4 are moved together into the fully locked position. During the described closing process, the contact surface 11*a* interacts with the pin 13 on the rotary latch 3, so that the pivoting movement of the actuating lever 10 in anti-clockwise direction, initiated by the drive 5, 6, 7, 8, 9, corresponds at the same time to a likewise pivoting anti-clockwise movement on the rotary latch 3. It must be taken into consideration that because the actuating lever 10 is angled, its pivoting angle is smaller than the pivoting angle of the rotary latch 3. Compared to pin 9 of cam 8, the driving pawl 11 is arranged radially inwardly in relation to the axis of rotation of the actuating lever 10.

During this process, the latching pawl 12 as a whole ensures that the lever actuating mechanism 10, 11, 12 remains in its engaged state, as in this state or in the engaged state the lever actuating mechanism 10, 11, 12 ensures a mechanically effective connection between the drive 5, 6, 7, 8, 9 and the locking mechanism 3, 4. This means that the latching pawl 12 holds the driving pawl 11 with its contact surface 11*a* against the pin 13 of the rotary latch 3.

In case of an interruption during the described closing operation or if the closing operation is subjected to an emergency interruption, this emergency interruption is initiated in the example by an operator acting upon the external operating lever 15 in the direction of the arrow shown in FIG. 3. This causes the triggering lever or ejecting lever 14 interacting with the external operating lever 15 to act upon the latching pawl 12 in such a way that it is pivoted in clockwise direction around the axis arranged on the actuating lever 10.

This causes the associated contact surfaces 12*a* on the latching pawl 12 and 11*b* and on the driving pawl 11 to no longer abut against each other and the driving pawl 11 is thus released from the latching pawl 12. Consequently, a mechanically effective connection between the drive 5,6,7,8,9 and the locking mechanism 3, 4 no longer exists as the stop face 11*a* on the driving pawl 11 evades and can evade the pin 13 on the rotary latch 3.

This process is further assisted by the fact that the stop face 11*a* of the driving pawl 11 facing the locking mechanism 3, 4 or the pin 13 thereon, contains a pre-cut, as shown in the magnified view of FIG. 3. This pre-cut or the bevel causes a force exerted by a pin 13 on the driving pawl 11 to pivot the driving pawl 11 away from the pin 13 in clockwise direction.

This force exerted by the pin 13 is produced by the fact that a rotary latch 3 is pretensioned with the aid of a not expressly shown spring in the "open" direction, i.e. in clockwise direction. This is indicated by an arrow in the enlarged view of FIG. 3. This means that the rotary latch 3 moves in clockwise direction without any impact or without being acted upon as a result of the force exerted by the spring.

This force which is naturally also applied to the pin 13 now causes the driving pawl 11 and its pre-cut in the stop face 11*a* facing pin 13, to be directly pivoted away from the pin 13 as soon as the latching pawl 12 does not (any longer) block such movements. This is the case as soon as the stop face 12*a* of the latching pawl 12 has left the other stop face 11*b* of the driving pawl 11. This is ensured by the triggering lever or ejecting lever 14 and the activation of the external operating lever 15 in the example.

It is immediately apparent that an emergency interruption of the closing function requires only very little force, as in case of the invention it is only necessary for the latching pawl 12 to be pivoted slightly in clockwise direction with the aid of the triggering lever or ejecting lever 14. Immediately afterwards, the force of the spring assigned anyway to the rotary latch 3 is used to pivot the driving pawl 11 away from the pin 13 due to the pre-cut so that the lever actuating mechanism 10, 11, 12 is immediately moved into its disengaged state and the mechanically effective connection between drive 5, 6, 7, 8, 9 and the locking mechanism 3, 4 is interrupted.

As a result, the locking mechanism 3, 4 is directly released which then naturally also applies for the locking bolt 2, if the motor vehicle door lock 1 is in its "unlocked" state. Otherwise, or in the "locked" state, the locking mechanism 3, 4 returns to the intermediate closed position or intermediate locked position. The closing function is, in any case, interrupted. In most cases, the motor vehicle door lock 1 is, however, unlocked at the same time. The motor vehicle door belonging to the motor vehicle door lock 1 can therefore be directly opened or the drive 5, 6, 7, 8, 9 has no impact as regards the closing function.

If the closing function is not interrupted, the motor vehicle door lock is in the position shown in FIG. 3 after closing. The motor 5 reverses into its position of FIG. 1, which then of course also applies to the worm gear 7, the cam 8 and the pin 9. The lever actuating mechanism 10, 11, 12 remains nonetheless engaged, as long as the external operating lever 15 in the example is not being acted upon.

During the described emergency interruption, the locking mechanism 3, 4 either moves back into the intermediate closed position shown in FIG. 2 (if the motor vehicle door lock 1 remains unchanged in its "locked" position) or the locking mechanism 3, 4 is released as a whole and moves into the "open" position shown in FIG. 1, when the motor vehicle door lock 1 is unlocked or has already been unlocked. —The complete drive 5, 6, 7, 8, 9 must not necessarily be integrated in the motor vehicle door lock 1 as shown. It is generally also possible for the drive 5, 6, 7, 8, 9 to be sited away from the motor vehicle door lock 1 and to be connected to said drive by means of a Bowden cable.

Figure 4:
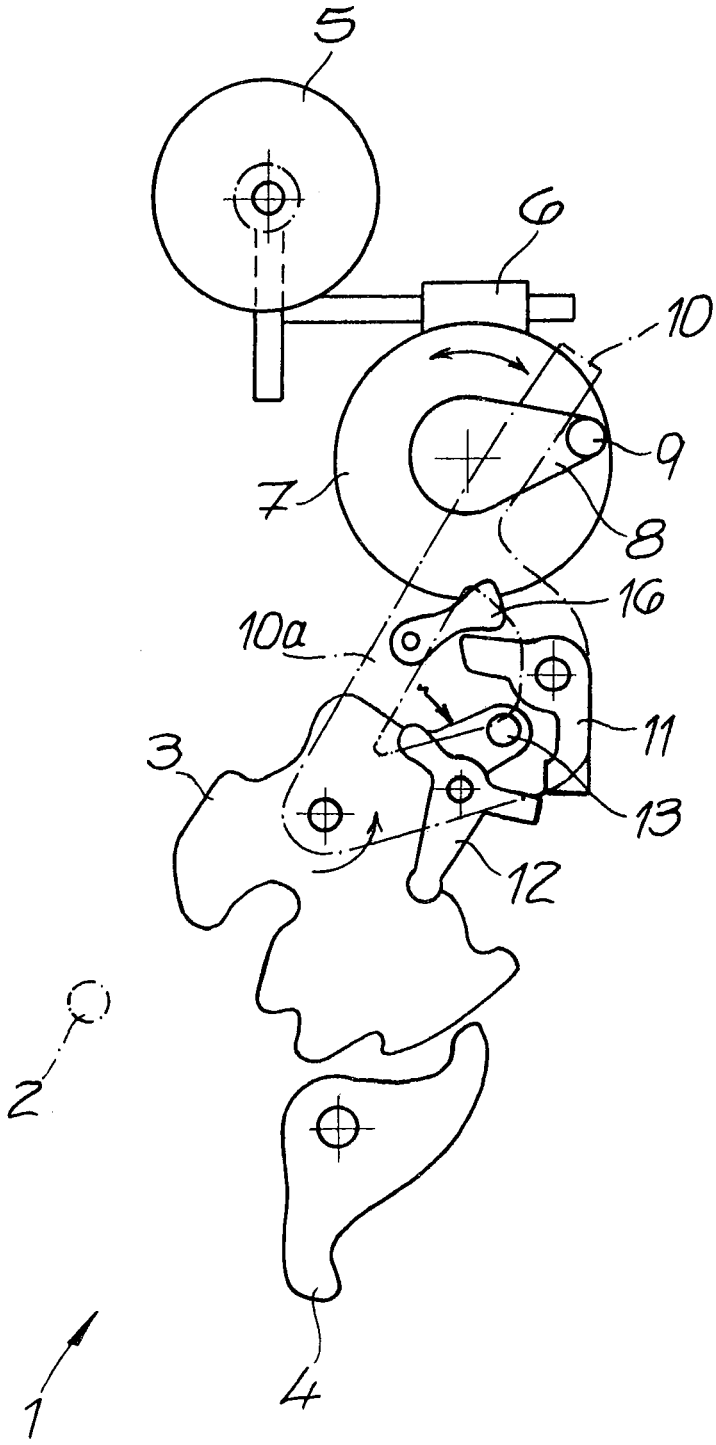
FIG. 4 shows a modified embodiment.

In the alternative embodiment shown in FIG. 4, the actuating lever 10 is no longer predominantly S-shaped but has an additional connecting web 10*a* in the area of the lower S-bend. A control lever 16 is arranged on the connecting web 10*a* or generally on the actuating lever 10 or is mounted on the actuating lever 10. This control lever 16 is provided in addition to the pawls, pawl 11 and latching pawl 12 mounted as usual on the actuating lever 10.

The control lever 16 serves to engage the driving pawl 11 in the rotary latch 3. The control lever 16 actuates the driving pawl 11 as soon as the rotary latch 3 has reached the intermediate closed position and the drive 5,6,7,8,9 has been switched on. The control lever 16 is triggered by cam 8, 9. The closing operation only commences once the driving pawl 11 is coupled to the rotary latch 3. One advantage of the control lever 16 is the prevention of an undesired collision between the driving pawl 11 and the transmission lever 10 with the rotary latch 3, where the driving pawl 11, as in case of the solution provided by the invention, is not directly triggered by cam 8,9. The control lever 16 can, as shown in FIG. 4, be triggered by the shape of the cam 8,9, also triggering the transmission lever 10. The scope of the invention does, however, also allow for the control lever to be triggered by a second control contour of the cam 8, 9 not shown in the figures.

It is to be understood that the above-described embodiments are illustrative of only a few of the many possible specific embodiments which can represent applications of the principles of the invention. Numerous and varied other arrangements can be readily devised by those skilled in the art without departing from the spirit and scope of the invention.

What is claimed is:

1. A motor vehicle door lock, comprising:

a locking mechanism (3, 4) and a closing/opening device (5 to 12), containing at least a drive (5, 6, 7, 8, 9) acting upon a lever actuating mechanism (10, 11, 12), which contains at least two parts, a driving pawl (11) and a latching pawl (12), wherein both pawls (11, 12) or both pawls (11, 12) and a control lever (16) are jointly mounted on an actuating lever (10) acted upon by the drive (5, 6, 7, 8, 9), wherein a sensor detects an intermediate closed or intermediate locked position of the motor vehicle door lock, causing the drive (5, 6, 7, 8, 9) to operate such that the lever actuating mechanism (10, 11, 12) in an engaged state, engages a pin (13) of the locking mechanism (3, 4), and wherein the lever actuating mechanism (10, 11, 12) in its engaged state provides a mechanically effective connection between the drive (5, 6, 7, 8, 9) and the locking mechanism (3, 4) through the latching pawl (12) blocking the driving pawl (11), and wherein in a disengaged state of the lever actuating mechanism (10, 11, 12), a triggering lever (14) acts upon the latching pawl (12) to release its blocking of the driving pawl (11).

2. The motor vehicle door lock according to claim 1, wherein both pawls (11, 12) or both pawls (11, 12) and the control lever 16 are axially offset on the actuating lever (10).

3. The motor vehicle door lock according to claim 1, wherein the actuating lever (10) is a lever mounted at one end.

4. The motor vehicle door lock according to claim 3, wherein the actuating lever (10) is mounted on the same axis as the rotary latch (3) of the locking mechanism (3, 4).

5. The motor vehicle door lock according to claim 3, wherein a free end of the actuating lever (10) is acted upon by a cam (8, 9) of the drive (5, 6, 7, 8, 9).

6. The motor vehicle door lock according to claim 1, wherein the control lever (16) is acted upon by a cam (8, 9) of the drive (5, 6, 7, 8, 9).

* * * * *